US007793475B2

(12) United States Patent
Riggs

(10) Patent No.: US 7,793,475 B2
(45) Date of Patent: Sep. 14, 2010

(54) MOLDING MEMBER HAVING A PLURALITY OF FLANGES FOR ENGAGING WITH DRYWALL FINISHING MATERIAL

(76) Inventor: Justin C Riggs, 3149 E. Vaughn Ave., Gilbert, AZ (US) 85234

( * ) Notice: Subject to any disclaimer, the term of this patent is extended or adjusted under 35 U.S.C. 154(b) by 0 days.

(21) Appl. No.: 11/836,958

(22) Filed: Aug. 10, 2007

(65) Prior Publication Data

US 2008/0083179 A1 Apr. 10, 2008

Related U.S. Application Data

(60) Provisional application No. 60/836,755, filed on Aug. 11, 2006.

(51) Int. Cl.
*E04F 19/04* (2006.01)
*E04F 13/06* (2006.01)

(52) U.S. Cl. ..... 52/288.1; 52/255

(58) Field of Classification Search ..... 52/288.1, 52/254, 255, 256, 257, 287.1, 716.1, 717.03, 52/717.04, 717.05, 717.06; D25/136
See application file for complete search history.

(56) References Cited

U.S. PATENT DOCUMENTS 1,085,605 A * 2/1914 Gunn ..... 52/211
1,097,935 A * 5/1914 Pride ..... 52/255
2,569,916 A * 10/1951 Barnes, Sr. et al. ..... 52/255
3,201,910 A * 8/1965 Keesee ..... 52/287.1
3,821,869 A * 7/1974 Morgan ..... 52/259
3,855,746 A * 12/1974 Leggiere ..... 52/213
5,195,283 A * 3/1993 MacLeod et al. ..... 52/95
5,426,901 A * 6/1995 Indracek ..... 52/288.1
5,501,043 A * 3/1996 Park ..... 52/92.1
5,564,233 A * 10/1996 Norton ..... 52/60
5,579,617 A * 12/1996 Schiedegger et al. ..... 52/288.1
5,729,933 A * 3/1998 Strength ..... 52/96
5,735,084 A * 4/1998 Zaccagni et al. ..... 52/11
5,740,642 A * 4/1998 Koenig et al. ..... 52/255
5,881,502 A * 3/1999 Tamlyn ..... 52/94
5,904,016 A * 5/1999 Koenig et al. ..... 52/255
5,974,748 A * 11/1999 Sciuga et al. ..... 52/287.1
6,539,675 B1 * 4/2003 Gile ..... 52/96
6,591,575 B2 * 7/2003 Benedettini ..... 52/716.1
6,782,666 B1 * 8/2004 Condon et al. ..... 52/93.2
6,988,345 B1 * 1/2006 Pelfrey et al. ..... 52/519
7,200,970 B2 * 4/2007 Koenig et al. ..... 52/287.1
D553,758 S * 10/2007 Turjanski ..... D25/102
7,296,387 B2 * 11/2007 Milu ..... 52/716.4
7,318,282 B2 * 1/2008 Pulte ..... 29/897
2002/0124485 A1 * 9/2002 Pulte ..... 52/96
2003/0226327 A1 * 12/2003 Perry ..... 52/287.1

(Continued)

*Primary Examiner*—Gay Ann Spahn

(57) ABSTRACT

A decorative molding member includes a decorative face adapted to project from the wall when installed thereon, the decorative face including a first side and a second side. A rigid first planar portion adjoins the first side of the decorative face. The rigid first planar portion includes a first perforated planar portion having an array of apertures extending therethrough and projecting outwardly from the decorative face in a first direction. A first support portion that is coplanar with the first perforated planar portion projects behind the decorative face. The first side of the decorative face and the first planar portion together form a rigid T-shape. A second planar portion adjoins the second side of the decorative face and projects outwardly from the decorative face in a second direction that is different from the first direction.

4 Claims, 16 Drawing Sheets

U.S. PATENT DOCUMENTS

2004/0118076 A1* 6/2004 Bezubic, Jr. ..... 52/716.1
2004/0211141 A1* 10/2004 Sandy ..... 52/506.01
2005/0166529 A1* 8/2005 Rodolofo et al. ..... 52/716.1
2005/0172571 A1 8/2005 Koenig, Jr. et al.
2005/0183352 A1 8/2005 Koenig, Jr. et al.
2005/0193664 A1 9/2005 Koenig, Jr. et al.
2005/0193671 A1* 9/2005 Brochu et al. ..... 52/506.01
2005/0241250 A1* 11/2005 Tarr ..... 52/266
2005/0262784 A1* 12/2005 Justice ..... 52/287.1
2006/0053727 A1* 3/2006 Bland et al. ..... 52/648.1
2006/0196144 A1* 9/2006 Spek ..... 52/720.1
2006/0213142 A1* 9/2006 Albracht ..... 52/543
2006/0272238 A1* 12/2006 Honda ..... 52/211
2006/0277853 A1* 12/2006 Dillon ..... 52/287.1
2006/0283110 A1* 12/2006 Ferguson ..... 52/211
2007/0107357 A1* 5/2007 O'Neal ..... 52/518
2007/0204554 A1* 9/2007 Leffler ..... 52/716.1
2009/0064614 A1* 3/2009 Spek ..... 52/288.1

* cited by examiner

MOLDING MEMBER HAVING A PLURALITY OF FLANGES FOR ENGAGING WITH DRYWALL FINISHING MATERIAL

CROSS-REFERENCE TO RELATED APPLICATIONS

This application claims the benefit of Provisional Application No. 60/836,755, filed Aug. 11, 2006.

TECHNICAL FIELD

The present invention generally relates to molding for decorating walls in a home, office, or other structure, and further relates to drywall finishing methods that utilize such molding.

BACKGROUND

Molding is often used to provide a decorative appearance to a corner or junction where a wall interfaces with another structural or decorative member that creates a discontinuity. Such structural or decorative members include a ceiling, doorway, window, or floor. In such cases, the molding may advantageously hide otherwise undesirable features such as gaps or wiring that are formed by or placed along the discontinuity. Other moldings such as chair rails are attached to a continuous region in a wall surface rather than at an interfacing wall region.

Installation of molding is typically performed after installing various drywall trimming accessories, which constitute a different class of materials from molding and include elongate flat or curved strips that are usually made from a polymer material Drywall trimming accessories are installed between two or more walls, or between a wall and at least one structural or decorative member, in order to remove any appearance of discontinuity between the structural or decorative members. FIG. 1 is a perspective view of a conventional drywall trimming strip 110, and FIG. 2 is a cross-sectional view of the strip 110 installed along a corner defined by two drywall panels 140. The strip 110 has a central portion 120, which may be also called a "bullnose" portion because of its curvature, and two diverging flanges 130, which diverge from the central portion 120. Each of the flanges 130 includes a plurality of holes 136, which provide numerous contact points for a joint compound to adhere to the dry wall panels 140.

FIGS. 3 and 4 are perspective views of other conventional drywall trimming accessories. As with the trimming strip 110 depicted in FIGS. 1 and 2, the trimming accessories are installed to remove any appearance of discontinuity between structural or decorative members. FIG. 3 depicts a three-way drywall trimming corner 150 that has three legs 110, each leg having a "bullnose" central portion 112 and a tongue 114, which is adapted to fit under the "bullnose" central portion of a "bullnose" drywall trimming strip such as the strip 110 depicted in FIGS. 1 and 2. Each leg 110 has two flanges diverging at a right angle. Each of the flanges 120 of a given leg 110 and one of the flanges 120 of an adjacent leg are defined by a common, sheet-like portion 122 of the corner 150.

FIG. 4 depicts a two-way drywall trimming corner 200, which, has two legs 210, each having a "bullnose" central portion 212 with a tongue 214, which is adapted to fit under the "bullnose" central portion of a "bullnose" drywall trimming strip such as the strip 110 depicted in FIGS. 1 and 2, Each leg 212 has two flanges diverging at a right angle. One flange 220 of one leg and the other flange 220 of the other leg are defined by a common, sheet-like portion of the corner 222. The other flanges 230 of the respective legs meet at a right angle to form an L-shaped sheet 232.

As previously mentioned, installation of molding is typically performed after installing various drywall trimming accessories such as those depicted in FIGS. 1 to 4. This is because the task of drywall trimming installation is performed throughout a building to remove any appearance of discontinuity between most walls and other structural or decorative members, while molding is considered a decorative feature that is only installed over a few wall-to-wall, wall-to-window, and wall-to-floor interfaces, for example. As a result, molding is often installed over previously-installed drywall trimming accessories. Installation of drywall trimming accessories, followed by installation of molding that covers the drywall trimming accessories, is redundant and unnecessary, and frequently requires hiring separate specialized crews.

Accordingly, there is a need for an accessory that is efficiently installed and that overcomes the inherent redundancies of installing both drywall trimming accessories and decorative molding across an interface between two or more walls or other structural or decorative members. Furthermore, other desirable features and characteristics of the present invention will become apparent from the subsequent detailed description and the appended claims, taken in conjunction with the accompanying drawings and the foregoing technical field and background.

SUMMARY OF THE INVENTION

According to one embodiment of the invention, a decorative molding member is provided for decorating a portion of a wall. The decorative molding member includes a decorative face adapted to project from the wall when installed thereon, the decorative face including a first side and a second side. A first perforated planar portion adjoins the first side of the decorative face, and includes an array of apertures extending therethrough. The first perforated planar portion projects outwardly from the decorative face in a first direction. A second perforated planar portion adjoins the second side of the decorative face, and includes an array of apertures extending therethrough. The second perforated planar portion projects outwardly from the decorative face in a second direction that is different from the first direction.

According to another embodiment of the invention, a decorative molding member includes a decorative face adapted to project from the wall when installed thereon, the decorative face including a first side and a second side. A rigid first planar portion adjoins the first side of the decorative face. The rigid first planar portion includes a first perforated planar portion having an array of apertures extending therethrough and projecting outwardly from the decorative face in a first direction. A first support portion that is coplanar with the first perforated planar portion projects behind the decorative face. The first side of the decorative face and the first planar portion together form a rigid T-shape. A second planar portion adjoins the second side of the decorative face and projects outwardly from the decorative face in a second direction that is different from the first direction.

BRIEF DESCRIPTION OF THE DRAWINGS

The present invention will hereinafter be described in conjunction, with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Referring to the figures, each illustrates an exemplary molding member according to various embodiments of the invention. Each of the molding members depicted in the figures is adapted to decorate a portion of a wall. The wall portion that is decorated by the molding member may define part of an interface between the wall and another structural or decorative member such as a window, a floor, a ceiling, or another wall, to name a few examples. In other embodiments, the wall portion that is decorated by the molding member may simply be a flat surface to which decorative molding such as chair railing is added.

Figure 1:
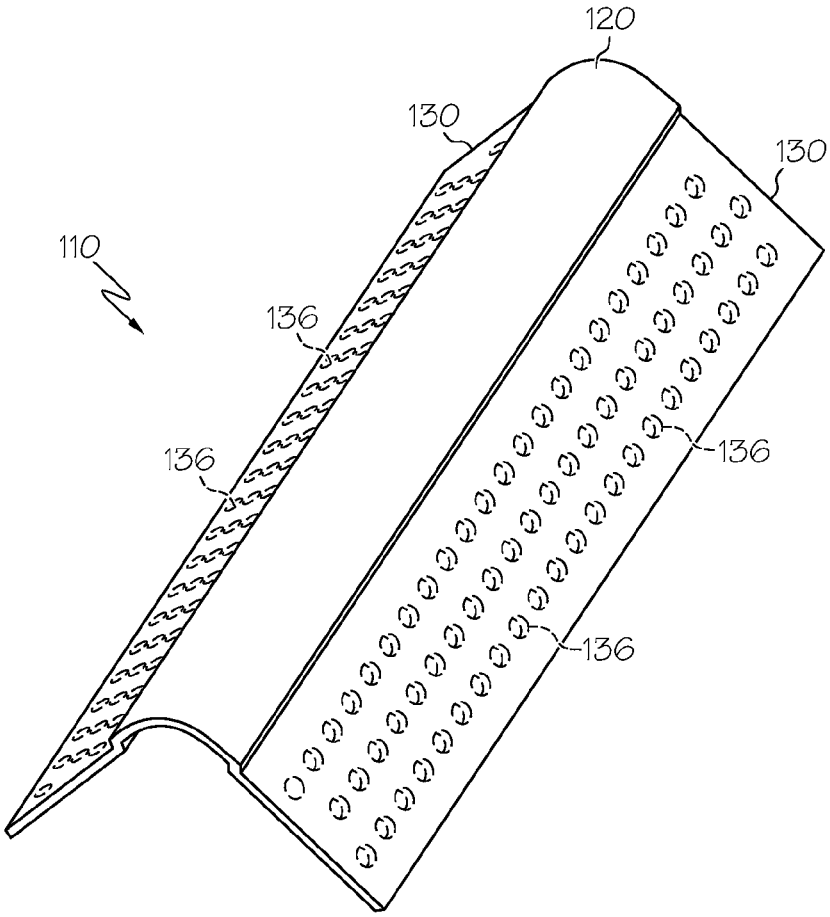
FIG. 1 (PRIOR ART)
FIG. 1 is a perspective view of a conventional drywall trimming strip.
Figure 2:
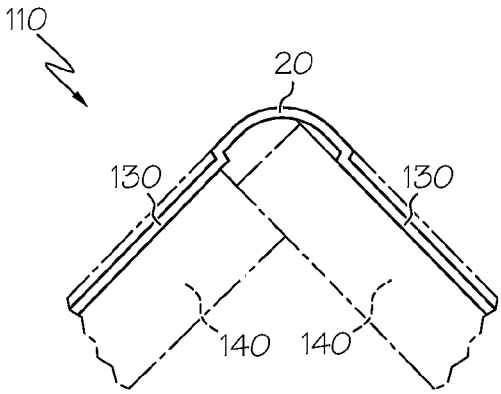
FIG. 2 (PRIOR ART)
FIG. 2 is a cross-sectional view of the strip depicted in FIG. 1 installed along a corner defined by two drywall panels.
Figure 3:
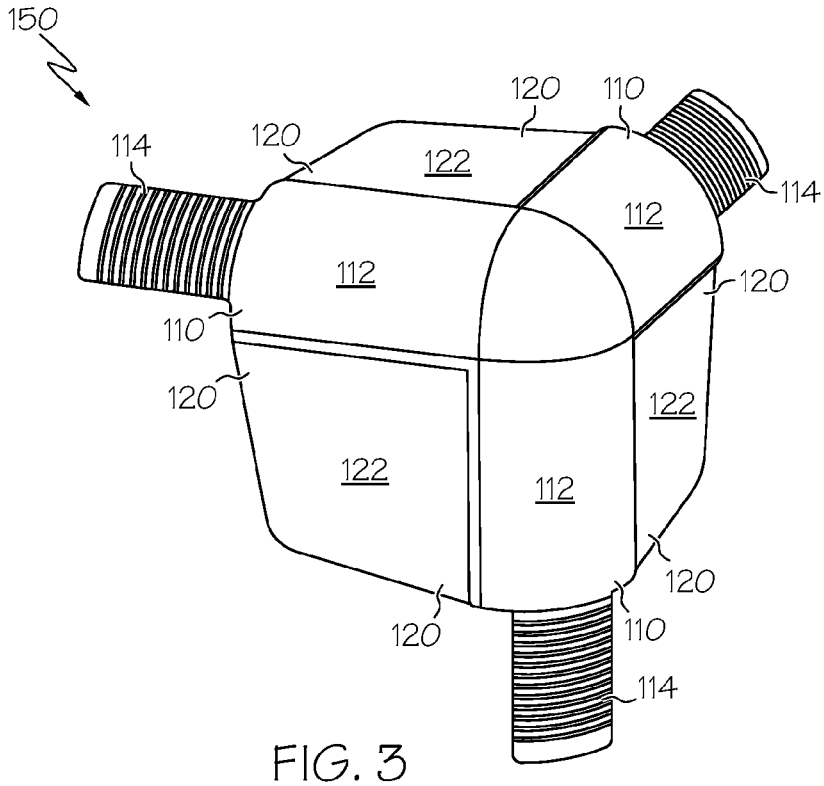
FIG. 3 (PRIOR ART)
FIGS. 3 and 4 are perspective views of other conventional drywall trimming accessories.
Figure 4:
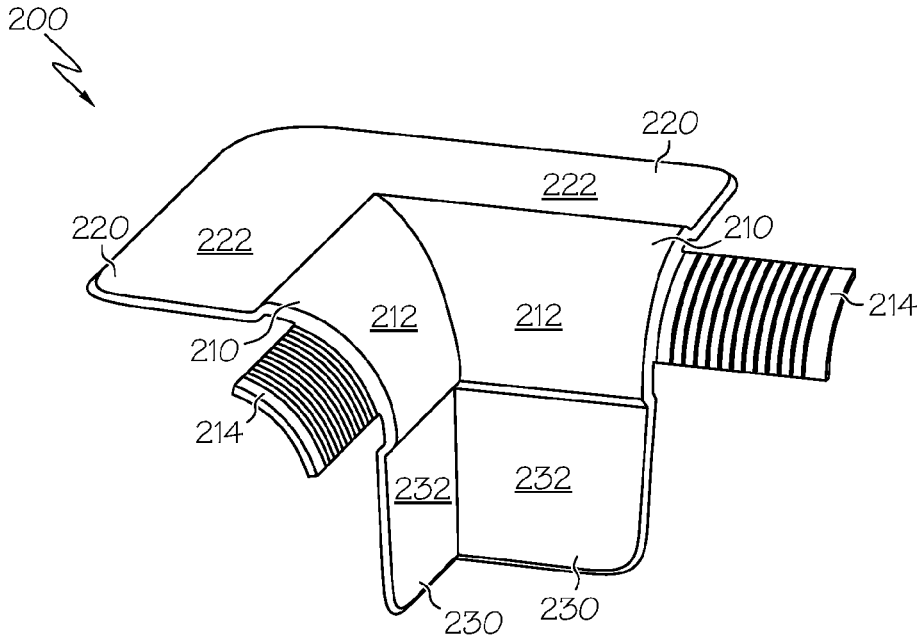
FIG. 4 (PRIOR ART)
Figure 5:
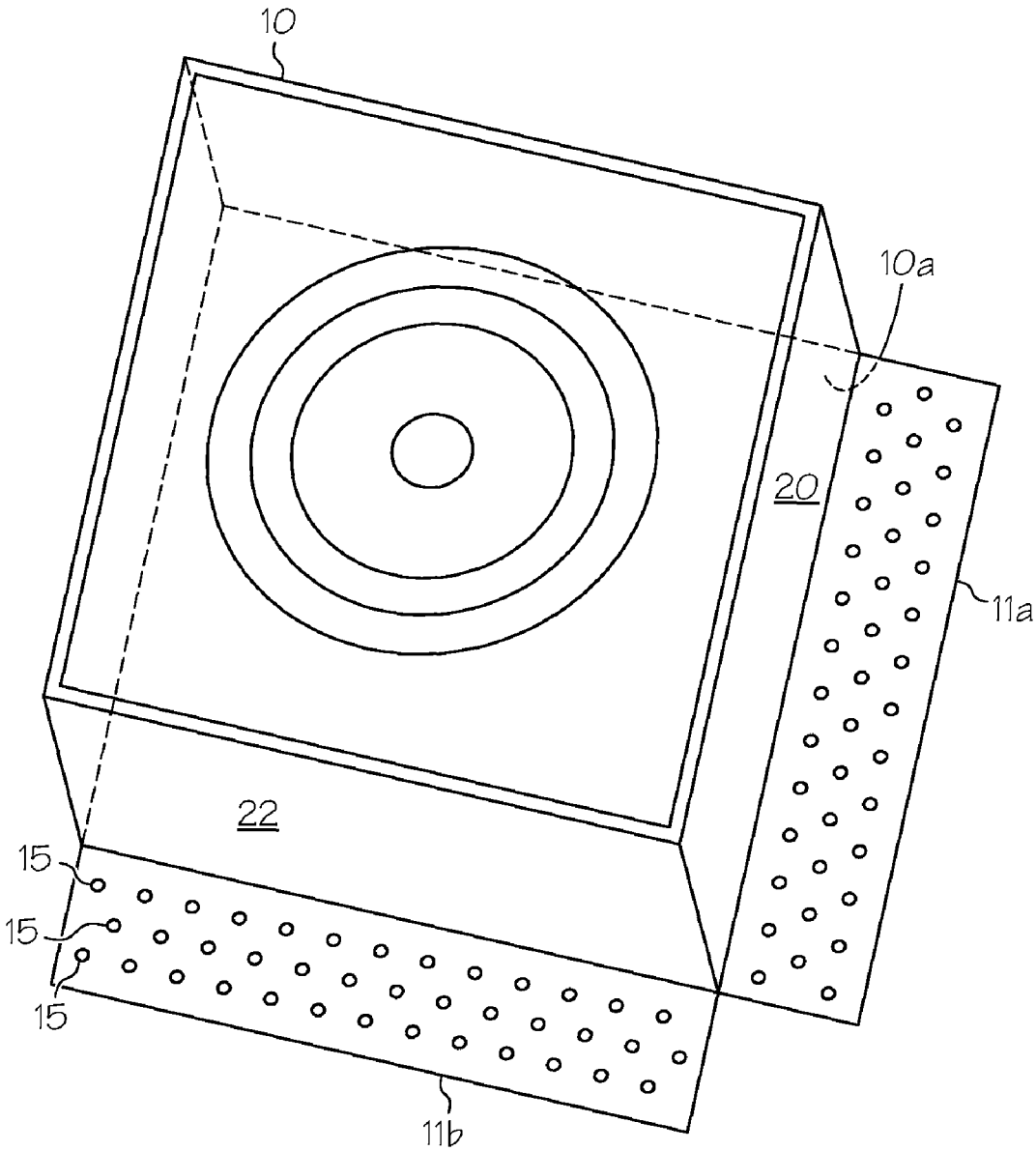
FIG. 5 is a perspective view of a corner molding member having first and second drywall joint compound flanges.
Figure 6:
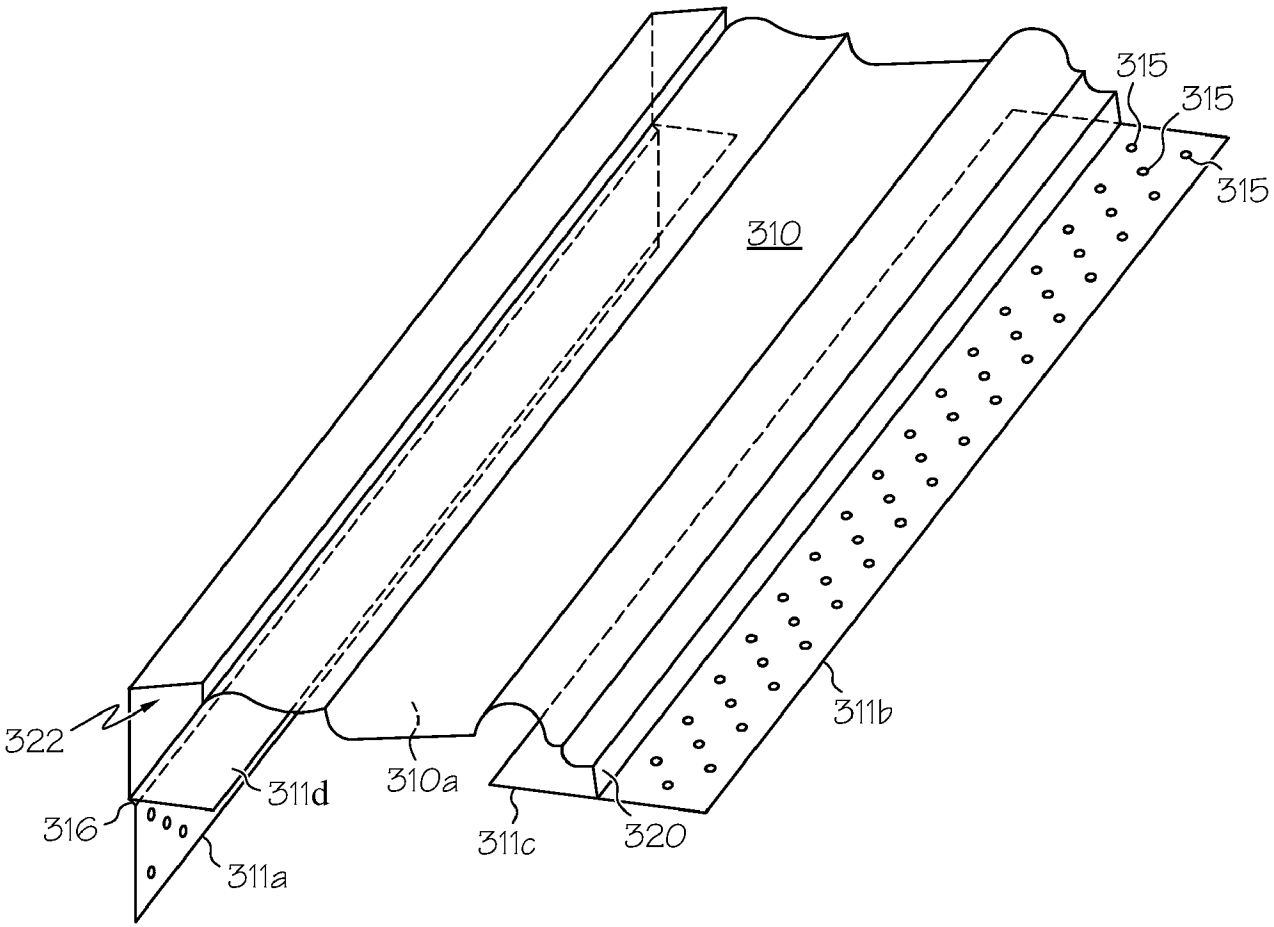
FIG. 6 is a perspective view of a casing molding member having first and second drywall joint compound flanges.
Figure 13:
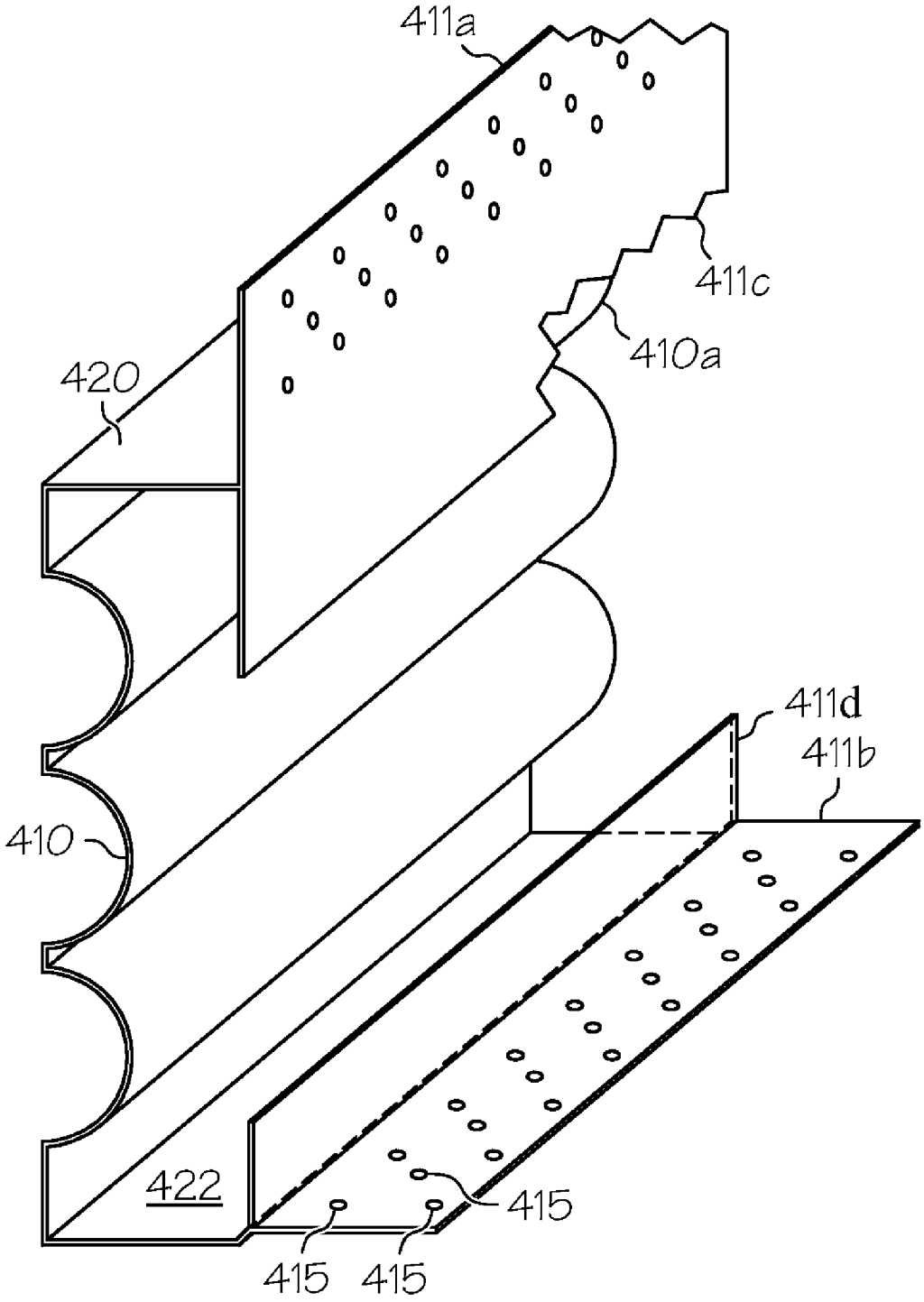
FIG. 13 is a rear perspective view of a fluted column molding member having first and second drywall joint compound flanges.

The reference numerals in FIGS. 5 to 18 identify structural features of the molding members of the present invention, many of which are structurally and functionally similar and, for ease in describing the invention, have similar reference numerals. For example, the corner molding member depicted in FIG. 5 includes structural features that are identified as follows: a decorative face 10, a rear surface 10*a*of the decorative face, a first side 20 of the decorative face, a second side 22 of the decorative face, a first planar flange 11*a*, a second planar flange 11*b*, and apertures 15 extending through the planar flanges. Several exemplary embodiments of molding members are disclosed, with each sharing common features. For ease in understanding how the common features are shared among the several embodiments, reference numerals identifying structural features in each embodiment have the last two digits of the corresponding structural features depicted in FIG. 1, with a preliminary digit that corresponds to that specific embodiment. Thus, the casing molding member depicted in FIGS. 6 to 7, and 16 to 18 has structural members including a decorative face 310, a rear surface 310*a*, and so forth. The fluted column molding member depicted in FIGS. 8 and 13 to 14 has structural members including a decorative face 410, a rear surface 410*a*, and so forth. The base molding member depicted in FIGS. 9 to 12 has structural members including a decorative face 510, a rear surface 510*a*, and so forth. Other structural features include an inverted flange identified as 311*c* for the casing molding, 411*c* for the fluted column molding, and 511*c* for the base molding. A lip member is identified with reference numeral 316 for the casing molding, 416 for the fluted column molding, and 516 for the base molding. Unless otherwise noted, the structural features will be described in relation to FIG. 5 although their descriptions apply to the other embodiments depicted in the drawings. Each of the decorative molding members of the present invention includes a decorative face 10. When installed on a wall the decorative face 10 is adapted to project from the wall. In other words, unlike drywall trimming members such as those previously discussed and depicted in FIGS. 1 to 4 that are installed between two faces and form a smooth transition therebetween, the decorative face 10 of the present invention protrudes away from the wall on which the molding is installed in order to provide contrast and ornamentation. The decorative face 10 often has a decorative curvature in at least one portion to draw a viewer's eyes toward the molding. Even if the decorative face is primarily a smooth and flat surface, the decorative face 10 protrudes away from the wall on which the molding is installed to provide a visual distinction between the molding and the adjacent one or more walls.

The figures depict various molding members, each including a decorative face 10 that is exposed for viewing upon installation of the molding member. As previously discussed, each decorative face 10 may have any number of possible dimensions and curvatures, including planar, corrugated, fluted, convex, and concave regions. In addition to their visual appeal, the molding members are also commonly adapted for specific utilities. For example, the corner block molding member illustrated in FIG. 5 may be mounted adjacent to a window corner. Furthermore, some moldings are shaped and sized as specific window casings, base boards, and as crown molding, to name just a few.

The decorative face 10 includes a first side 20 and a second side 22. A first perforated planar flange 11*a* adjoins the first side 20 of the decorative face. More particularly, an array of apertures 15 extends through the first planar flange 11*a*. As will be described in detail, the apertures 15 are included to aid the installer in securing the molding to a wall. The first perforated planar flange 11*a* projects outwardly from the decorative face 10. A second flange 11*b* that may also be planar adjoins the second side of the decorative face 10. According to some embodiments, the second flange 11*b* is like the first planar flange 11*a* as both include an array of apertures 15 extending therethrough, although in other embodiments the second flange 11*b* has a functionality for which apertures are neither useful nor advantageous. In either case, the second flange 11*b* projects outwardly from the decorative face 10 in a second direction that is different from the first direction at which the first perforated planar flange 11*a* extends.

The first and second flanges 11*a* and 11*b* are preferably formed as continuous members with the decorative face 10. More particularly, in an exemplary embodiment the first and second flanges 11*a* and 11*b* are formed from the same material as the decorative face 10, and preferably by a molding process in which the entire molding structure, including the flanges, is extruded and molded into a unitary and continuous piece.

Figure 7:
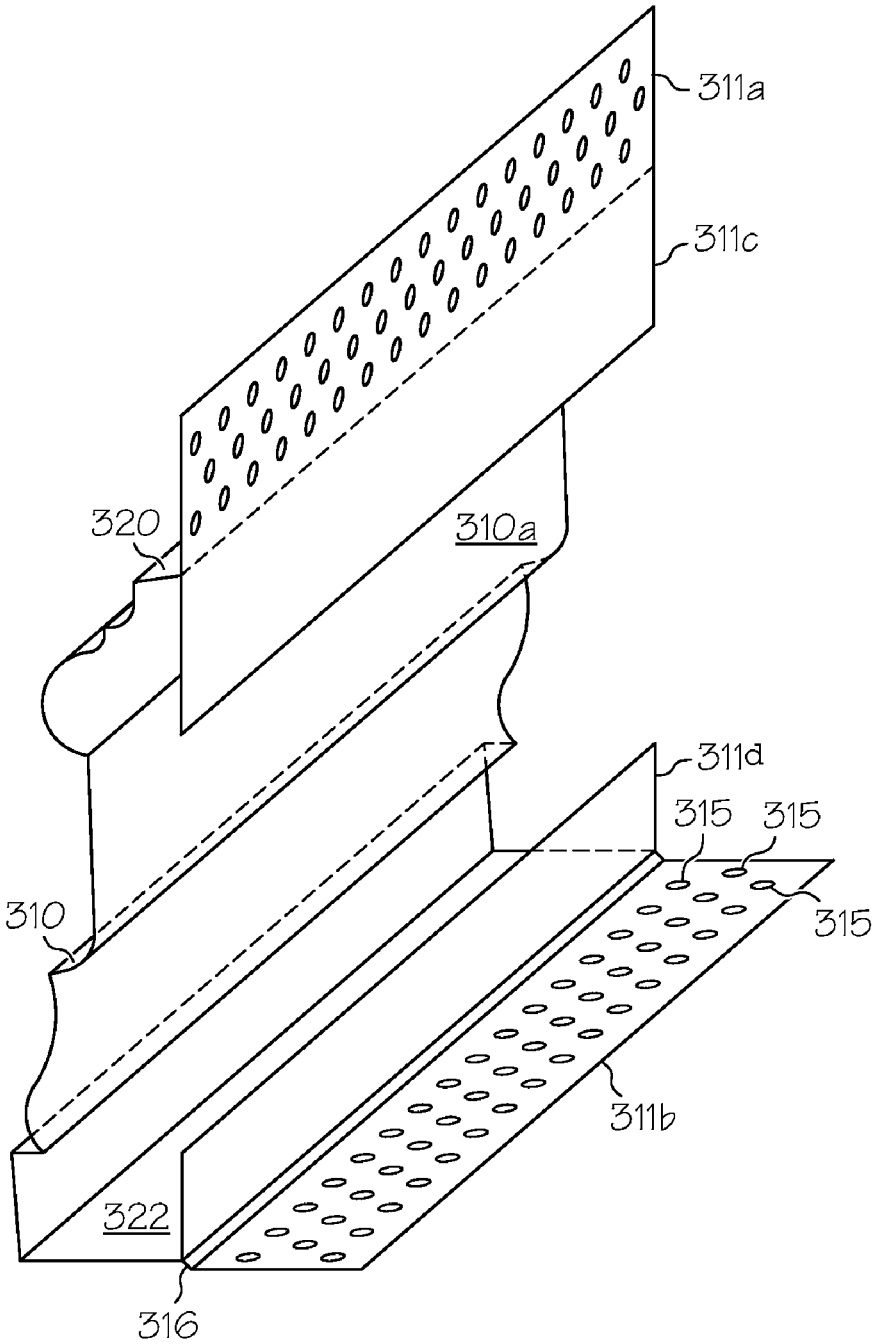
FIG. 7 is a rear perspective view of a casing molding member having first and second drywall joint compound flanges.
Figure 8:
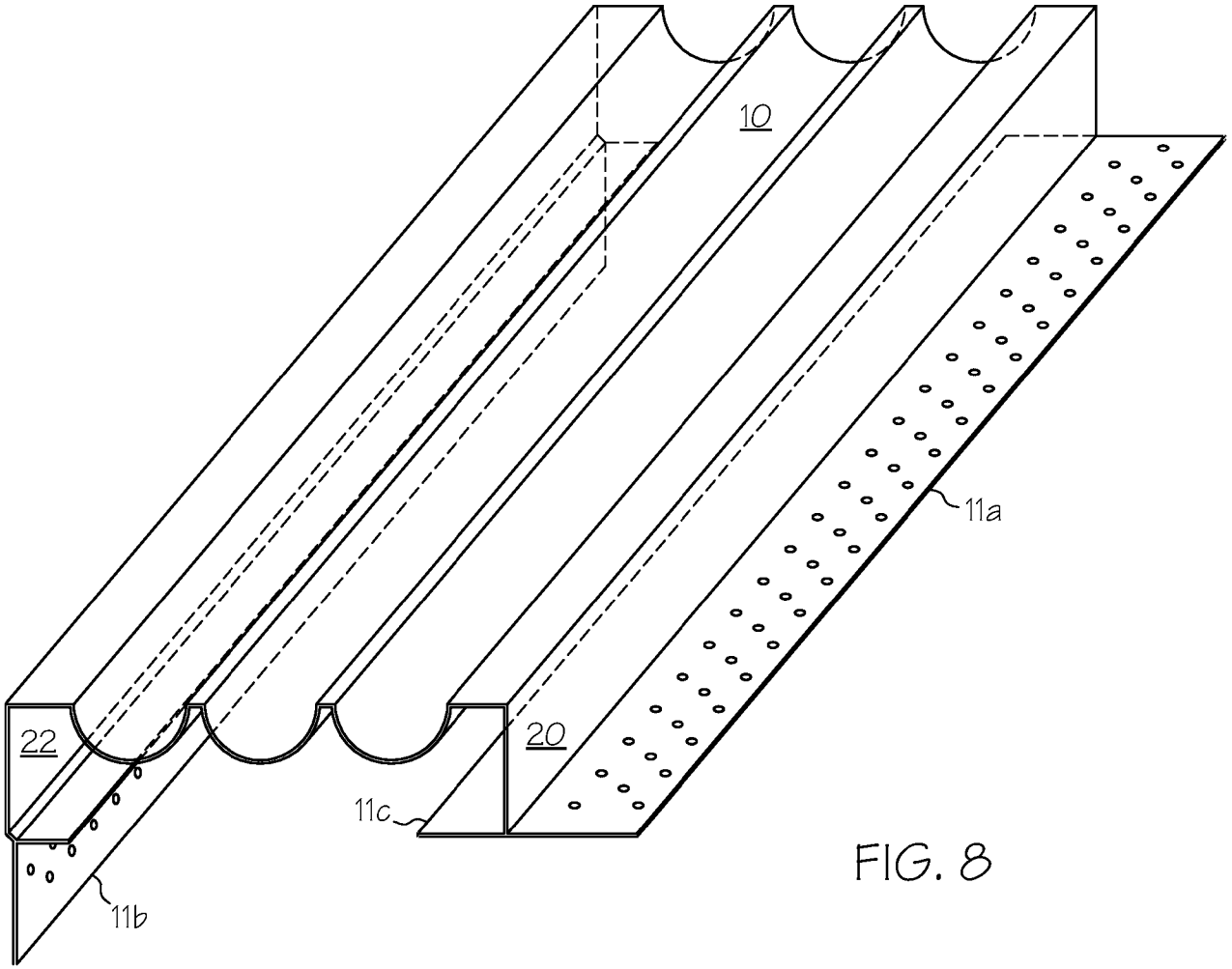
FIG. 8 is a perspective view of a fluted column molding member having first and second drywall joint compound flanges.
Figure 9:
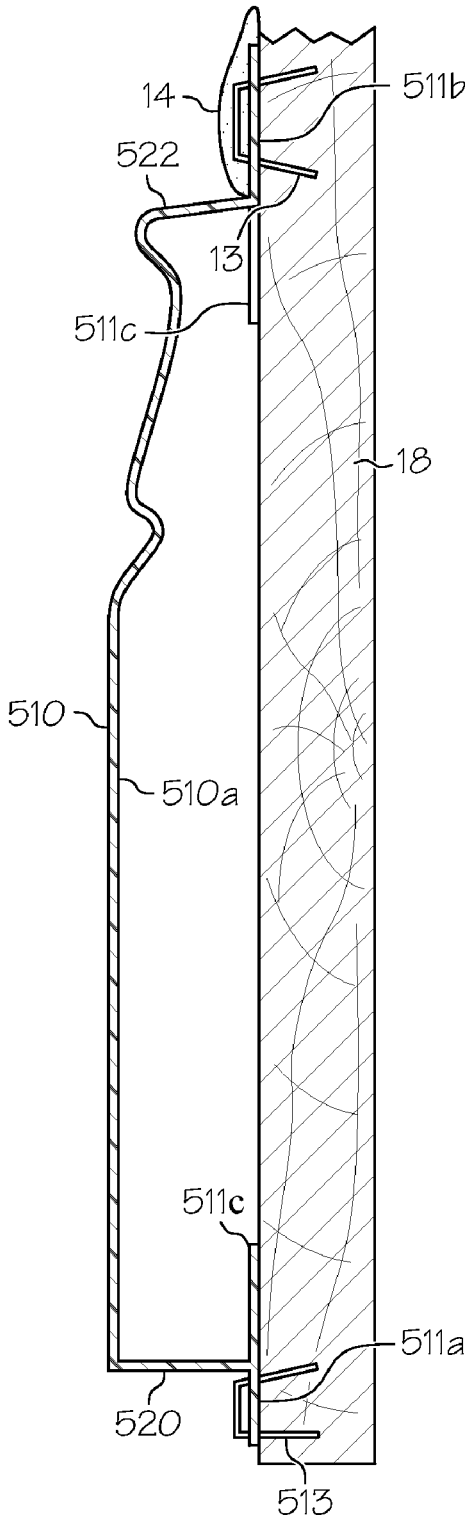
FIG. 9 is a cross-sectional side view of a base molding member having a drywall joint compound flange installed to a wall using staples and drywall joint compound, and a stapling flange installed to a wall using staples.
Figure 10:
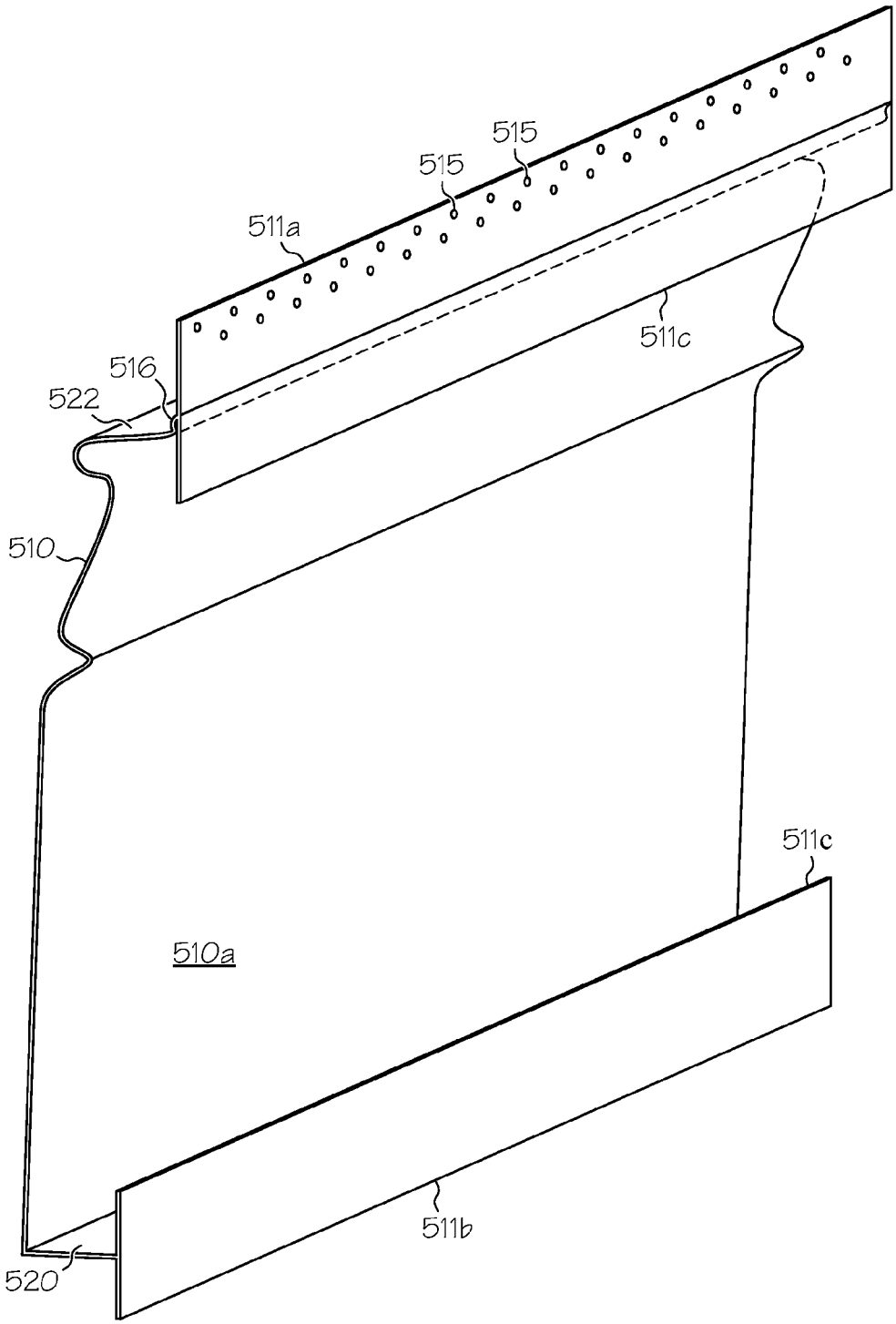
FIG. 10 is a rear perspective view of a base molding member having a drywall joint compound flange and a stapling flange, along with a lip member.
Figure 11:
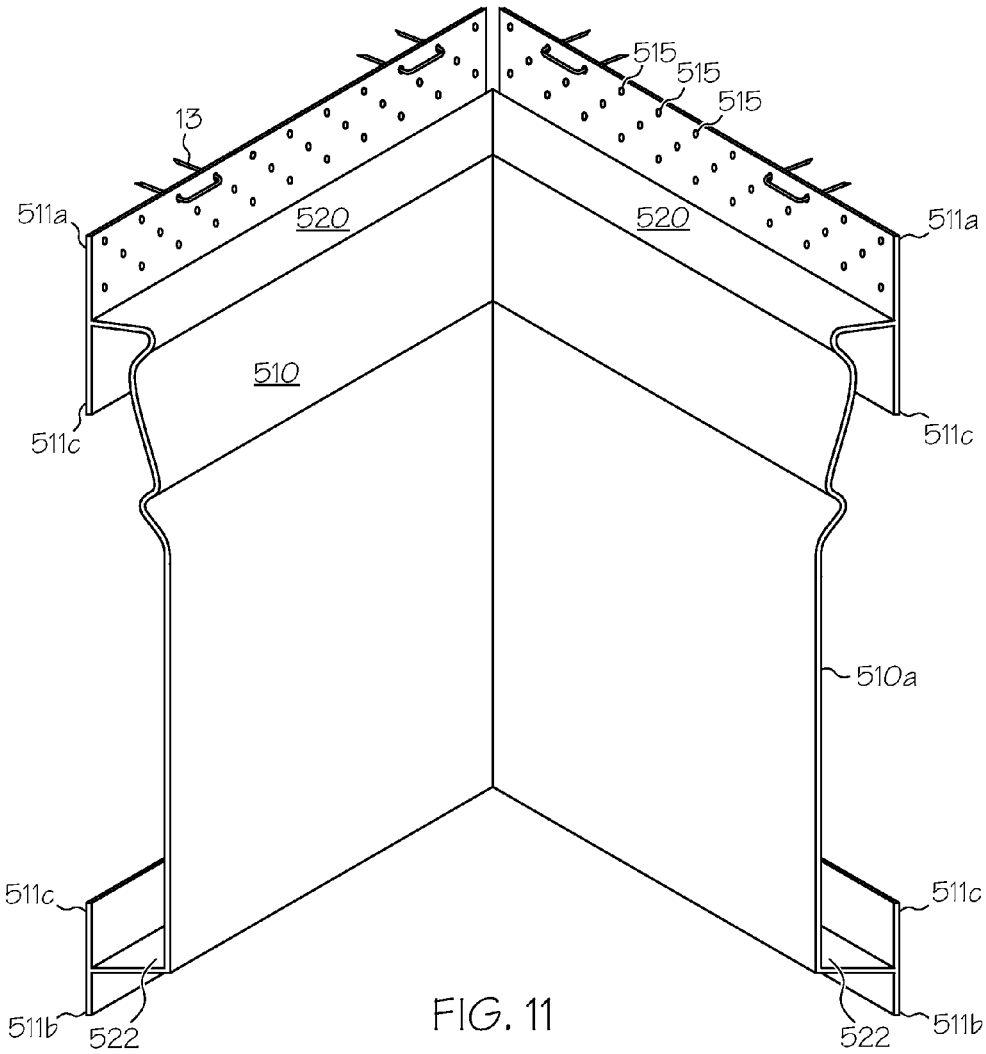
FIG. 11 is a perspective view of a base inside corner molding member having a drywall joint compound flange and a stapling flange.
Figure 12:
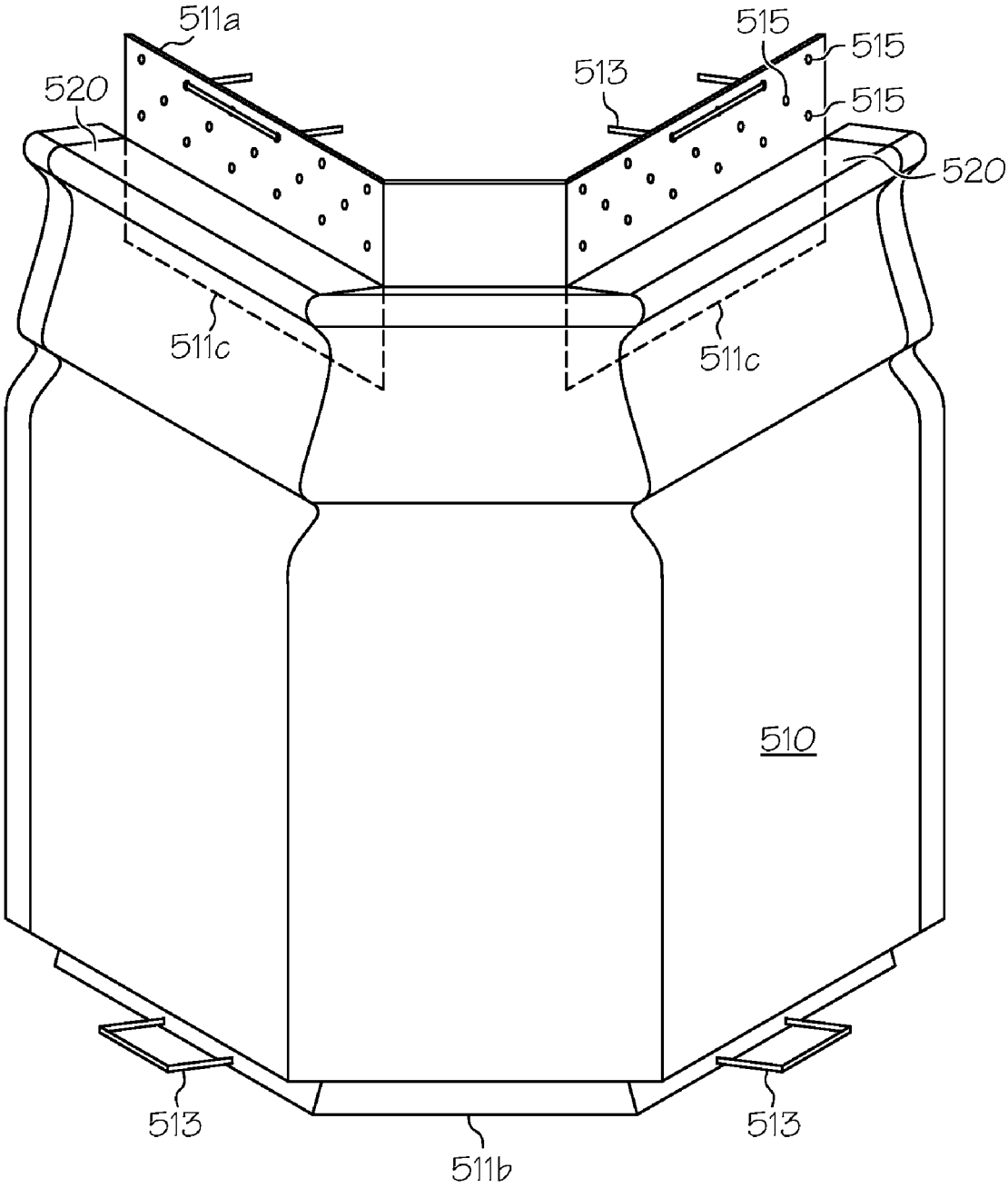
FIG. 12 is a perspective view of a base outside corner molding member having a drywall joint compound flange and a stapling flange.
Figure 16:
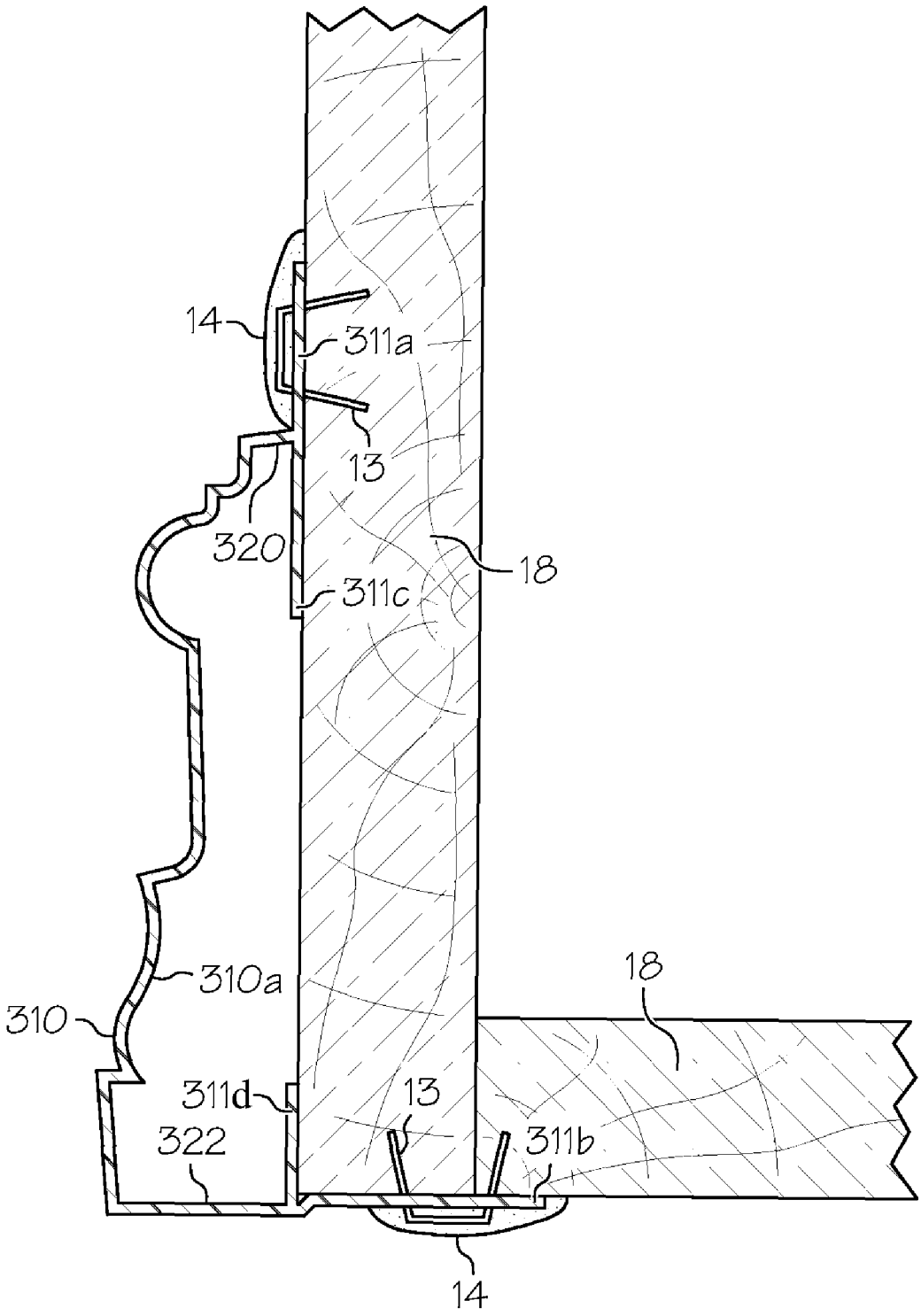
FIG. 16 is a cross-sectional view side view of a casing molding member having first and second drywall joint compound flanges attached to a wall using staples and drywall joint compound.

As previously mentioned, according to some embodiments each of the flanges 11*a* and 11*b* includes a plurality of apertures 15. During installation, a molding member is held in place against at least one wall 18, which is commonly formed from a drywall panel, although other materials such as plaster or texturing materials may constitute the actual surface against which the drywall member is placed. An adhesion composition such as drywall-finishing material, glue, or spray adhesive (all such adhesion compositions hereinafter being generally referred to as "joint compound") is applied to each of the flanges 11*a* and 11*b*. Some of the joint compound 14 is then pressed through at least some of the apertures 15. The joint compound 14 adheres to both of the flanges 11*a* and 11*b*, and also to the underlying wall surface. The apertures 15 provide numerous contact points for the joint compound to adhere to the wall 18. FIGS. 9 and 16 illustrate molding members installed to a wall 18 using staples 13 as well as joint compound 14. FIG. 7 is one of several figures that display a lip member 516 formed between a flange 511*a* and the decorative face 510. The lip member 516 is essentially an interfacing member that is provided so that joint compound does not contact the decorative face 510.

An important feature of the invention is that the two or more flanges 11*a* and 11*b* both extend outwardly and away from different edges of the decorative face 10. More particularly, the flanges 11*a* and 11*b* extend laterally outward with respect to the decorative face 10. A plurality of outwardly-extending flanges enables the flanges to be readily and quickly accessed by an installer. The flanges are also in this manner capable of being substantially coplanar for some moldings such as those illustrated in FIGS. 5, 8, and 9 to 12 for installation along a flat surface, or in substantially perpendicular planes for some moldings such as those illustrated in FIGS. 6, 7, 8, 13 to 14, and 16 to 18 for installation along two adjacent substantially perpendicular surfaces. The plurality of flanges 11*a* and 11*b* provides substantial stability for the molding member since each flange extends from different edges of the decorative face 10.

Figure 14:
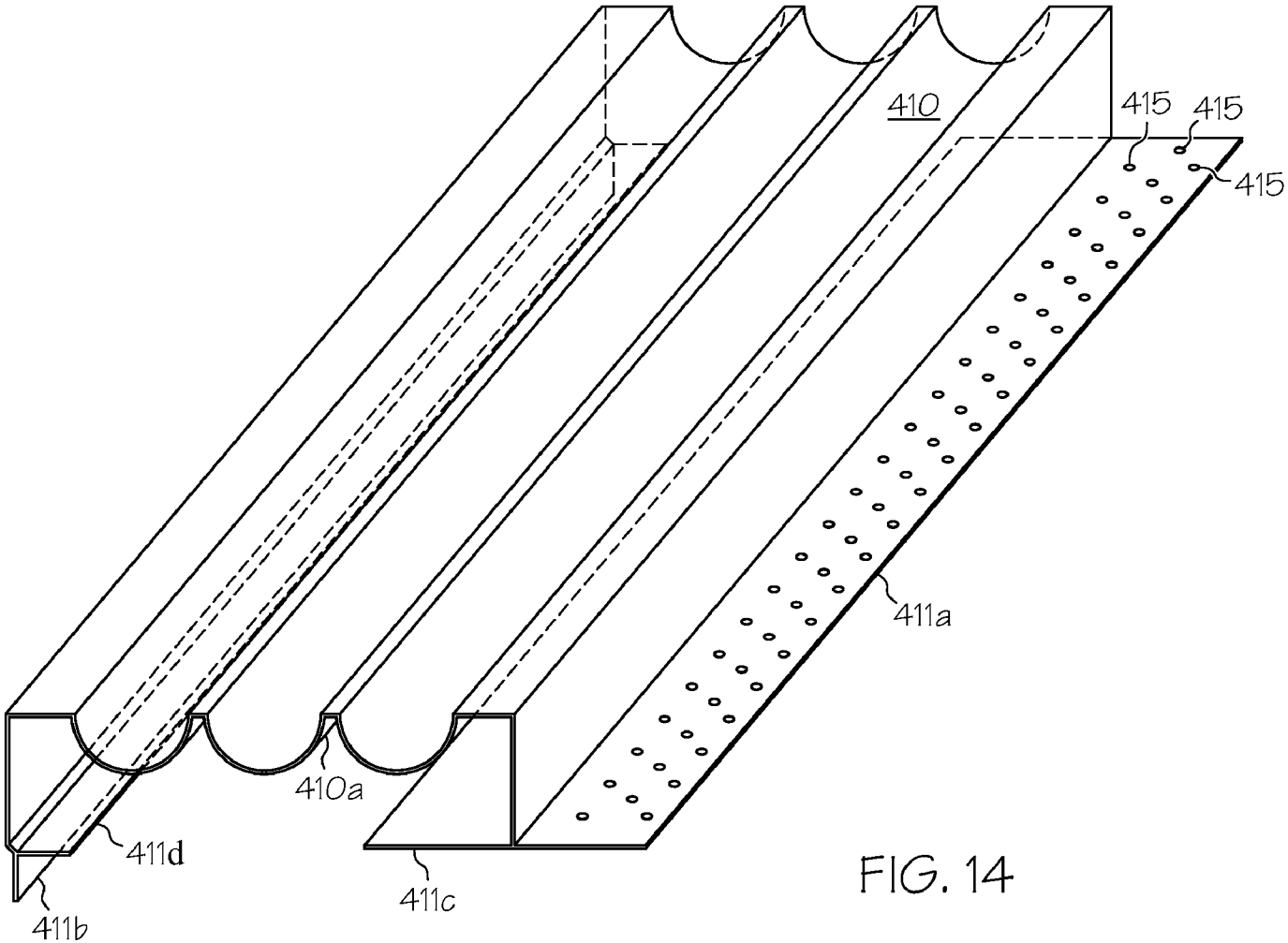
FIG. 14 is a perspective view of a fluted column molding member having a joint compound flange and a kerf flange.
Figure 15A:
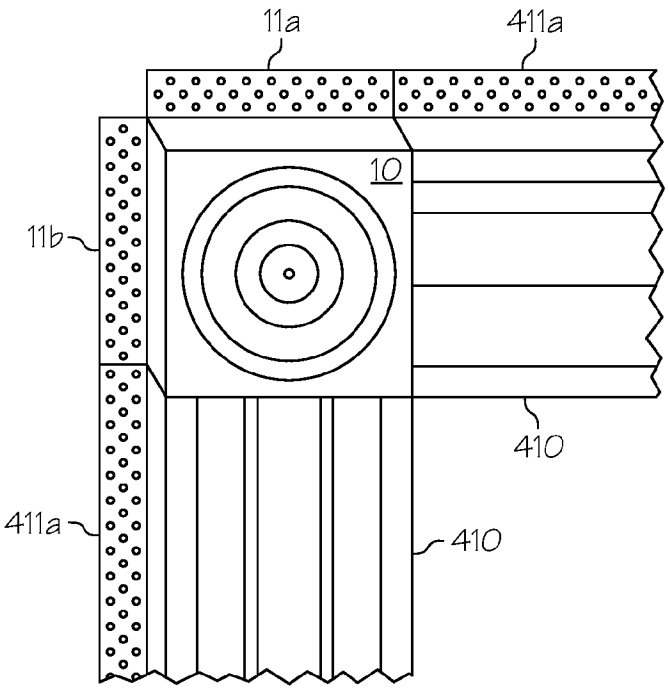
FIG. 15A is a close-up perspective view of the molding members illustrated in FIG. 17.
Figure 15:
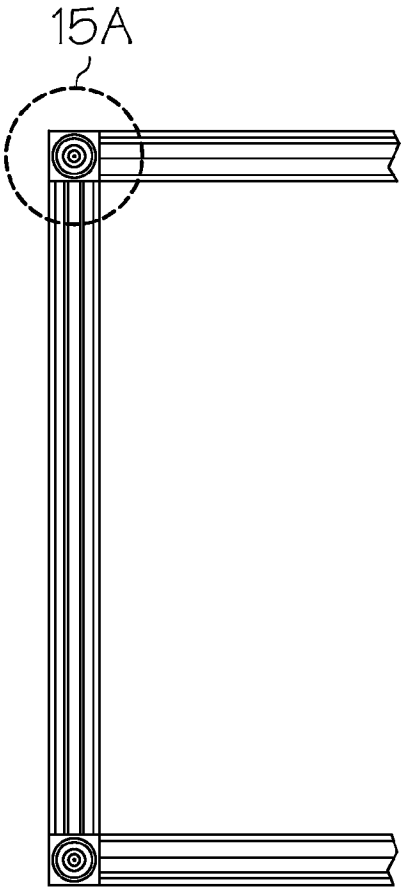
FIG. 15 is a front view of a window decorated with cap, corner, and fluted column molding members of the present invention.
Figure 17:
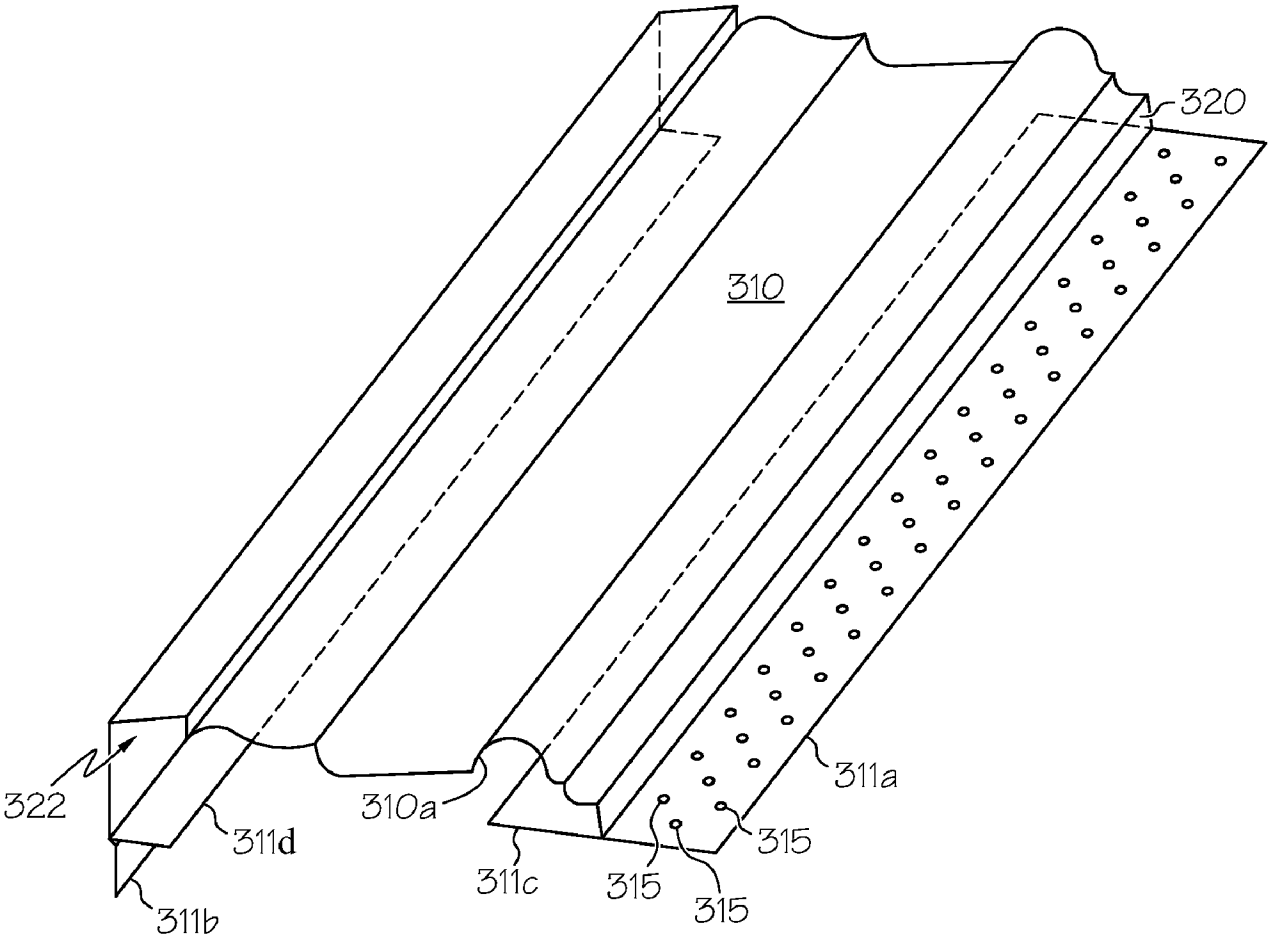
FIG. 17 is a perspective view of a casing molding member having a drywall flange and a kerf flange.
Figure 18:
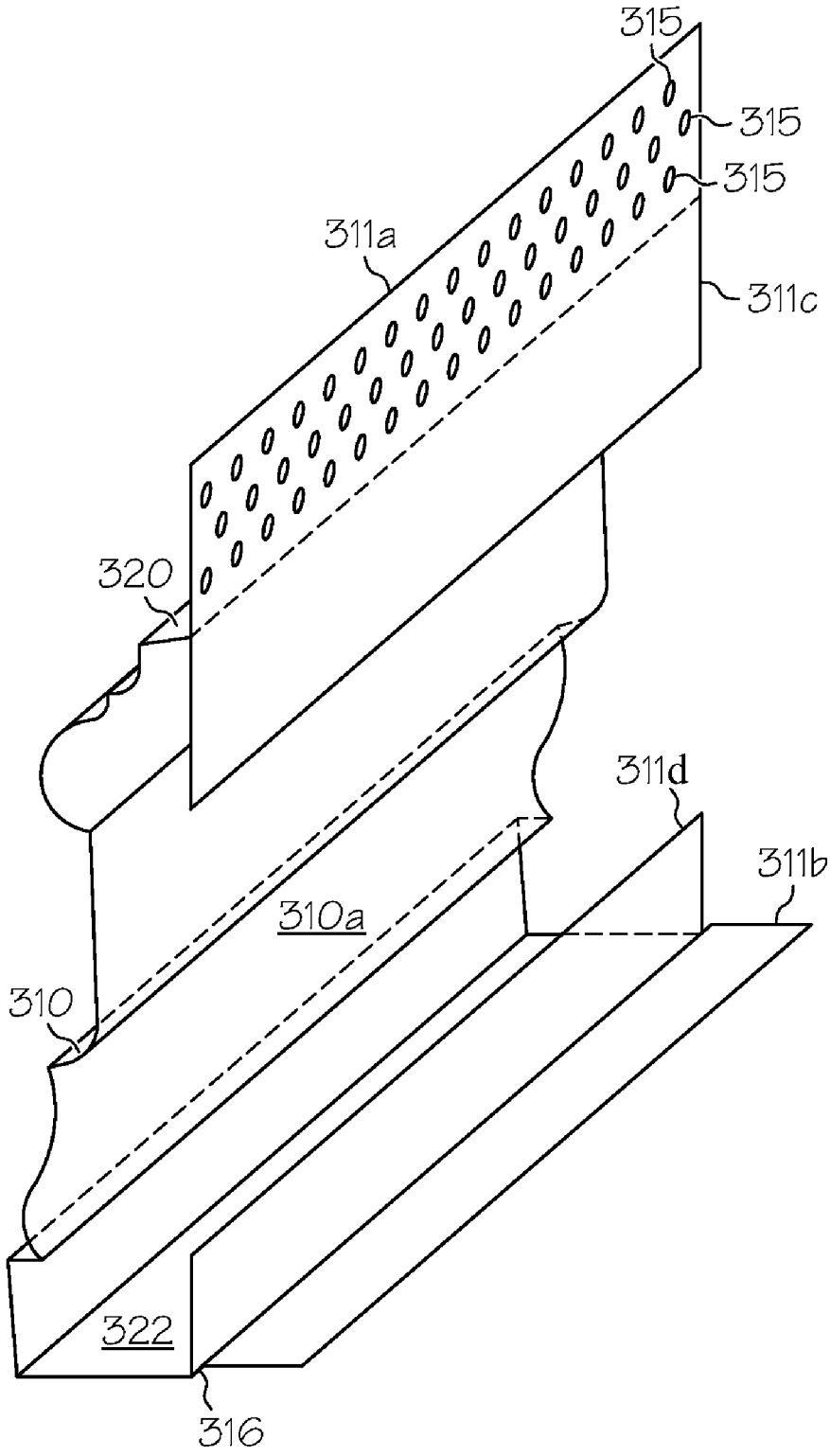
FIG. 18 is a rear perspective view of a casing molding member having a drywall flange and a kerf flange.

According to another embodiment, illustrated in FIGS. 11 to 12, 14, and 17 to 18, only one of the flanges is perforated with apertures. The flange that is not perforated is useful for mounting using a different method than using drywall joint compound. For example, in FIGS. 11 and 12, flanges 511*b* are lower flanges on a base molding member, which may be hidden after installation with carpet or another smaller molding member, to name just a couple of examples. Staples alone may be used to attach the lower flanges 511*b* to a wall. In FIGS. 14, and 17 to 18, the flange 411*b* is a kerf flange that may be inserted and held in place between a pair of door or window jambs. In all of these embodiments, the plurality of flanges i.e. 411*a*, 511*a*, 411*b*, and 511*b* still extend away from different edges of the decorative face i.e. 410, 510. More particularly, the plurality of flanges extend laterally outward with respect to the decorative face.

As previously mentioned, the various molding members are preferably continuously formed from a single material. Exemplary materials are polymers, including vinyl, polyurethane, polypropylene, and polyvinyl chloride to name just a few. Moldings made from polymer materials can be extrusion molded as thinly as desired.

According to a preferred embodiment of the invention such as the base molding depicted in FIGS. 9 to l2, at least one of the first planar flanges 511*a*, 511*b* is part of a larger planar surface that also includes a co-planar inverted flange 511*c* that protrudes inwardly behind the decorative face 510. The inverted flange 511*c* and the first planar flange 511*a* together form a rigid T-shape with the first side 520 of the decorative face 510. The rigid T-shape is preferably two substantially perpendicular members, and provides a sturdy support that reinforces the overall molding member. Particularly when the decorative face 510 is large, flat, or formed from a thin and/or weak material, the rigid T-shaped member formed from the first side 520 and the planar member including the inverted flange 511*c* and the first planar flange 511*a* prevents the molding member from being damaged if subjected to force during or following installation.

Furthermore, another inverted flange 311*d*, 411*d* is included in various embodiments including the casing molding and fluted column moldings. For example, the inverted flange 311*d* is depicted in FIGS. 6 to 7, and 16 to 18. In this case, the additional inverted flange 311*d* forms a rigid L-shape with the second flange 311*b*. All of the inverted flanges 311*d* are formed to abut and rest against a layer of drywall to provide support for the molding member and prevent damage if it is subjected to mechanical force.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function, and arrangement of elements without departing from the scope of the invention as set forth herein.

What is claimed is:

1. A decorative molding member installed on a portion of a wall, the decorative molding member comprising:

a decorative main body portion having first and second ends, a decorative front surface, and a rear surface that extends from the first end to the second end, the entire rear surface covering but separated from the wall, the decorative main body portion comprising a first side and a second side;

a rigid first planar portion directly adjoining the first end of the decorative main body portion and installed in contact with the wall, the rigid first planar portion comprising a first planar flange having a first plurality of apertures distributed about the first flange and extending therethrough and projecting outwardly from the decorative main body portion in a first direction, and a first support portion that is coplanar with the first planar flange and projecting behind the decorative main body portion, wherein the first side of the decorative main body portion and the first planar portion together form a rigid T-shape;

a second planar flange directly adjoining the second end of the decorative main body portion and installed in contact with the wall, the second planar flange projecting outwardly from the decorative main body portion in a second direction that is different from the first direction; and a second support portion projecting from the second side of the decorative main body portion and also projecting behind the decorative main body portion, wherein the second support portion and the second planar flange together form a rigid L-shape.

2. The decorative molding member according to claim 1, wherein the second planar flange comprises a second plurality of apertures substantially evenly distributed about the entire second flange and extending therethrough.

3. The decorative molding member according to claim 1, wherein the first and second sides are oppositely positioned on the decorative main body portion, and the first and second directions in which the first and second planar flanges project from the decorative main body portion are in substantially parallel or substantially common planes.

4. The decorative molding member according to claim 3, wherein the first and second sides are oppositely positioned on the decorative main body portion, and the first direction in which the first planar flange projects outwardly from the decorative main body portion is 90 degrees from the second direction in which the second planar flange projects outwardly from the decorative main body portion.

* * * * *